US009211969B2

(12) United States Patent
Maze et al.

(10) Patent No.: US 9,211,969 B2
(45) Date of Patent: Dec. 15, 2015

(54) SPECIMEN CONTAINER

(75) Inventors: Jack Edward Maze, Long Grove, IL (US); Kenneth Su Chua, Glenview, IL (US)

(73) Assignee: Medline Industries, Inc, Mundelein, IL (US)

( * ) Notice: Subject to any disclaimer, the term of this patent is extended or adjusted under 35 U.S.C. 154(b) by 0 days.

(21) Appl. No.: 12/709,855

(22) Filed: Feb. 22, 2010

(65) Prior Publication Data

US 2011/0204058 A1 Aug. 25, 2011

(51) Int. Cl.

| | |
|---|---|
| ***B65D 1/10*** | (2006.01) |
| ***B65D 41/04*** | (2006.01) |
| ***B65D 85/72*** | (2006.01) |

(52) U.S. Cl.

CPC ..... *B65D 1/10* (2013.01); *B65D 41/0421* (2013.01); *B65D 85/72* (2013.01); *B65D 2543/00388* (2013.01)

(58) Field of Classification Search

CPC ..... B65D 2543/00388; B65D 2543/00342; B65D 41/0428; B65D 41/0421; B65D 41/0414; B65D 41/0407; B65D 41/04

USPC ..... D9/435; 215/247, 344, 345, 343, 346, 215/341, 224, 216, 44, 43, 330, 316; 220/803, 289, 296, 213, 780, 802, 790, 220/783, 801, 796; 53/488, 487, 486, 485

IPC ..... B65D 41/04, 41/02, 55/02, 43/04

See application file for complete search history.

(56) References Cited

U.S. PATENT DOCUMENTS

| | | | | | |
|---|---|---|---|---|---|
| 2,243,754 | A | * | 5/1941 | Honegger | 220/583 |
| 2,543,427 | A | * | 2/1951 | Warne | 141/381 |
| 2,971,671 | A | | 2/1961 | Shakman | |
| 3,142,409 | A | * | 7/1964 | Ross | 220/281 |
| 3,189,072 | A | * | 6/1965 | Starr | 215/321 |
| 3,297,187 | A | * | 1/1967 | Thiesen | 215/272 |
| 3,409,167 | A | | 11/1968 | Blanchard | |
| 3,435,976 | A | * | 4/1969 | Owens | 215/329 |
| 3,441,161 | A | | 4/1969 | Baarn | |
| 3,525,455 | A | | 8/1970 | Saunders | |
| 3,664,544 | A | * | 5/1972 | Hammes | 220/320 |
| 3,707,241 | A | * | 12/1972 | Taylor | 215/337 |

(Continued)

FOREIGN PATENT DOCUMENTS

EP 0119788 9/1984

OTHER PUBLICATIONS

U.S. Appl. No. 61/296,283 [Coon], filed Jan. 19, 2010, Figs. 4, 5, and 15, pp. 1-25.*

(Continued)

*Primary Examiner* — Robert J Hicks

(74) *Attorney, Agent, or Firm* — Philip H. Burrus, IV

(57) ABSTRACT

A specimen container system (800) includes a lid (100) and a container (400). The lid (100) has an annular wall (201) and a central surface (104). The central surface (104) is configured to be conically shaped by tapering from the annular wall (201) to a point (208) disposed at an inner portion of the central surface (104). The container (400) and lid (100) can also include an audible locking system where a cantilevered audible lock projection (602) extending from the container (400) engages an audible lock actuation protrusion (217) extending from the lid (100) to make a click sound when the lid (100) is seated on the container (400).

17 Claims, 5 Drawing Sheets

(56) References Cited

U.S. PATENT DOCUMENTS

| | | | | | |
|---|---|---|---|---|---|
| 3,743,131 | A | * | 7/1973 | Croyle et al. | 220/802 |
| 3,788,510 | A | | 1/1974 | Collins | |
| 3,827,593 | A | * | 8/1974 | Kramb et al. | 215/208 |
| 3,830,391 | A | * | 8/1974 | Uhlig | 215/216 |
| 3,973,690 | A | | 8/1976 | Schneider | |
| 4,027,776 | A | | 6/1977 | Douglas | |
| 4,206,852 | A | | 6/1980 | Dunn et al. | |
| 4,274,544 | A | * | 6/1981 | Westfall | 215/344 |
| 4,283,498 | A | | 8/1981 | Schlesinger | |
| 4,489,845 | A | | 12/1984 | Aichinger et al. | |
| 4,574,966 | A | | 3/1986 | Sandhaus | |
| 4,616,761 | A | | 10/1986 | Nolan | |
| 4,678,082 | A | | 7/1987 | Fillmore | |
| 4,714,167 | A | | 12/1987 | Sandhaus | |
| 4,771,905 | A | | 9/1988 | Perne et al. | |
| 4,793,510 | A | * | 12/1988 | Arfert et al. | 220/793 |
| 4,852,753 | A | | 8/1989 | Ochs | |
| 4,966,780 | A | | 10/1990 | Hargraves et al. | |
| 5,152,418 | A | * | 10/1992 | Kroeschell et al. | 220/359.4 |
| 5,186,344 | A | | 2/1993 | Cook | |
| 5,251,770 | A | | 10/1993 | Bartley et al. | |
| 5,316,054 | A | * | 5/1994 | Hall et al. | 141/22 |
| 5,458,252 | A | | 10/1995 | Logel | |
| 5,655,677 | A | | 8/1997 | Fratello et al. | |
| 5,779,086 | A | | 7/1998 | Barrash | |
| 5,855,289 | A | | 1/1999 | Moore | |
| 5,865,330 | A | * | 2/1999 | Buono | 215/216 |
| 5,865,353 | A | * | 2/1999 | Baudin | 222/546 |
| 5,899,349 | A | | 5/1999 | Moore | |
| 6,039,090 | A | | 3/2000 | Gunn et al. | |
| 6,109,470 | A | | 8/2000 | Antal et al. | |
| 6,116,500 | A | | 9/2000 | Cahill | |
| 6,235,010 | B1 | | 5/2001 | Wilkinson et al. | |
| 6,257,431 | B1 | * | 7/2001 | Baudin | 215/237 |
| D457,247 | S | * | 5/2002 | Iheme et al. | D24/224 |
| 6,533,113 | B2 | * | 3/2003 | Moscovitz | 206/222 |
| D481,258 | S | * | 10/2003 | Brady et al. | D7/412 |
| D578,211 | S | | 10/2008 | Maze | |
| D583,230 | S | | 12/2008 | Maze | |
| 2004/0011759 | A1 | * | 1/2004 | Hahn et al. | 215/305 |
| 2004/0105786 | A1 | * | 6/2004 | Anderson et al. | 422/102 |
| 2011/0174642 | A1 | * | 7/2011 | Coon | 206/222 |

OTHER PUBLICATIONS

Starplex Scientific, Inc., "Specimen Containers", http://www.starplexscientific.com/Products/Leakbuster/Default.asp, viewed Mar. 6, 2012, unknown publication date.

Starplex Scientific, Inc., "Leakbuster 3", http://www.starplexscientific.com/Resources/Brochures/Leakbuster3.pdf, viewed Mar. 6, 2012, publication date unknown.

* cited by examiner

SPECIMEN CONTAINER

BACKGROUND

1. Technical Field

This invention relates generally to a container with a sealing lid, and more particularly to a specimen container having a lid with a conically shaped interior and an audible locking mechanism.

2. Background Art

Liquids such as biological samples are often collected during medical procedures and testing. These liquids are generally collected in a container. A lid is then attached to the container so that the liquid can be transported or stored.

The design of containers and closures suitable for use in these medical procedures can be troublesome. To be effective, the seal between container and lid must be reliable, watertight, and air tight. In many procedures, the possibility of even a small amount of the liquid leaking from the container is unacceptable.

To further complicate matters, containers carrying biological samples are often exposed to varying environmental forces. For example, during transport or storage specimen containers may be exposed to varying exterior pressure, varying internal pressure, and varying temperature. For example, in some applications the specimen stored within the container may cause the internal pressure within the container to create a pressure differential. Similarly, some transport modes can create pressure differentials from the exterior of the container. Further, the integrity of the seal between container and lid must remain even under mechanical shock, such as when the container is dropped. Any of these factors can cause a container and lid system to leak.

There is thus a need for an improved container and lid system that remains leak-proof in a variety of environments.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and to explain various principles and advantages all in accordance with the present invention.

Figure 1:
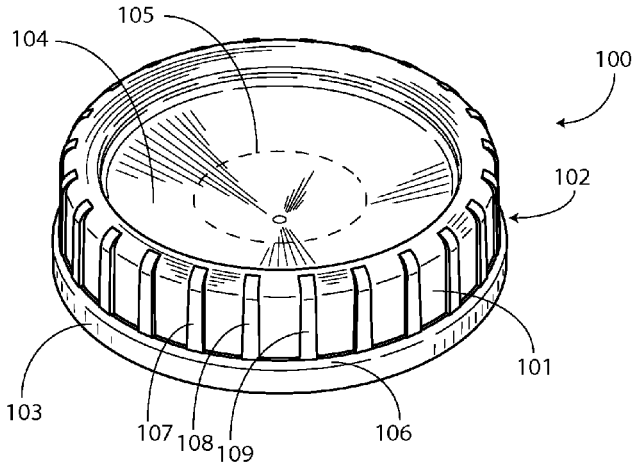
FIG. 1 illustrates a perspective view of one lid configured in accordance with embodiments of the invention.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION OF THE INVENTION

Embodiments of the invention are now described in detail. Referring to the drawings, like numbers indicate like parts throughout the views. As used in the description herein and throughout the claims, the following terms take the meanings explicitly associated herein, unless the context clearly dictates otherwise: the meaning of "a," "an," and "the" includes plural reference, the meaning of "in" includes "in" and "on." Relational terms such as first and second, top and bottom, and the like may be used solely to distinguish one entity or action from another entity or action without necessarily requiring or implying any actual such relationship or order between such entities or actions. Also, reference designators shown herein in parenthesis indicate components shown in a figure other than the one in discussion. For example, talking about a device (10) while discussing figure A would refer to an element, 10, shown in figure other than figure A.

Embodiments of the present invention provide a specimen container and lid. In one embodiment, the container comprises a three or four ounce container suitable for use in medical procedures. For example, the container can be used during procedures that collect bodily fluid samples from a patient.

In one embodiment, the container includes a lid having a conically shaped interior. Each can be manufactured from a thermoplastic material such as polypropylene by way of an injection molding process. The conically shaped interior portion provides a mechanical buttress that ensures that a leak-proof seal is formed between container and lid. By including a conical shape, when the lid is coupled to the container, internal pressures will push the point of the cone outward, thereby forcing the annular wall of the lid against the cylindrical sidewalls of the container. This works to create a more secure and more leak-proof coupling between lid and container.

In one embodiment, the container system includes an audible locking device that makes a "click" sound so that a medical professional knows that the lid is securely attached to the container. In one embodiment, the container and lid assembly are configured so as to be transportable through a vacuum transport system.

Figure 2:
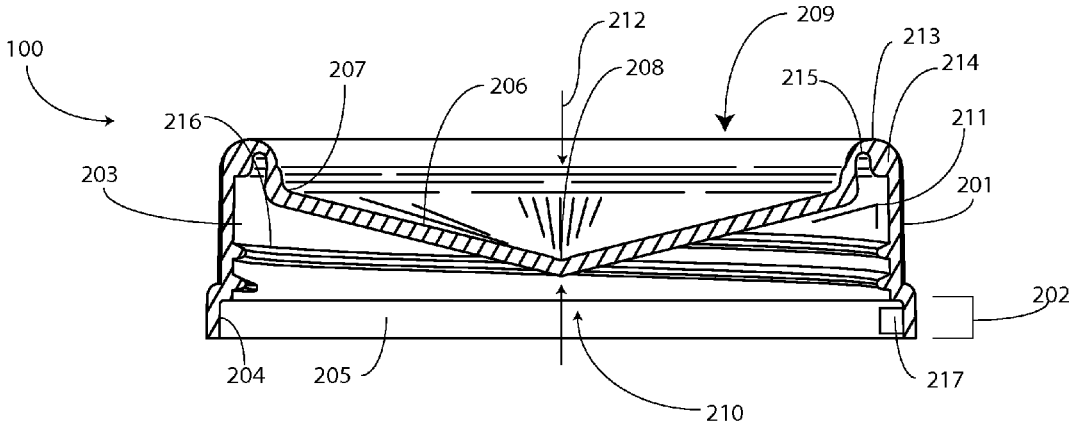
FIG. 2 illustrates a sectional view of one lid configured in accordance with embodiments of the invention.
Figure 3:
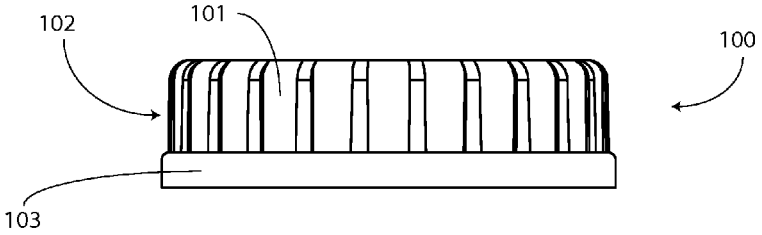
FIG. 3 illustrates a side, elevation view of one lid configured in accordance with embodiments of the invention.
Figure 5:
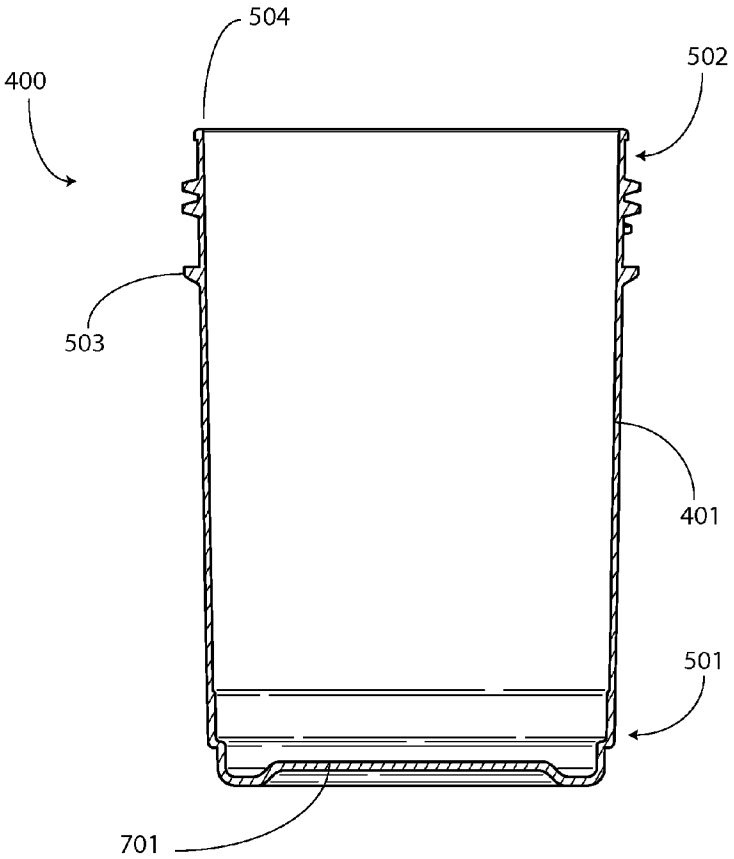
FIG. 5 illustrates a perspective view of one container configured in accordance with embodiments of the invention.

Turning now to FIGS. 1-3, illustrated therein is one embodiment of a lid 100 configured to engage a container, such as a specimen container, in accordance with embodiments of the invention. FIG. 1 illustrates a perspective view, while FIG. 3 illustrates a side elevation view. FIG. 2 illustrates a sectional view cut along a diameter of the lid 100. In one embodiment, the lid 100 has a diameter of between fifty and sixty millimeters so as to accommodate coupling to a three or four ounce container.

The lid 100 includes an annular wall 201 disposed about a perimeter of the lid 100. The annular wall 201 defines a first major face 101 that faces outwardly from a side portion of the lid 100. In one embodiment, lid 100 includes a container receiving well 202. The container receiving well 202 is a portion of the lid 100 that has a larger diameter than the remainder of the lid 100. Where a diameter running from an inner face 203 of the annular wall 201 were between fifty and fifty-three millimeters, a diameter running from an inner surface 204 of the container receiving well 202 may exceed the diameter running from the inner face 203 of the annular wall 201 by two to five millimeters. Illustrating by way of example, in one embodiment the diameter running from the inner surface 204 measures 52.9 millimeters, while the diameter running from the inner surface 204 of the container receiving well 202 is 55.0 millimeters.

The optional container receiving well 202, where included, makes it easier to initially align the lid 100 with a container. Where the central axis of the container and the central axis of the lid 100 are initially slightly misaligned, the container receiving well 202 can work as a mechanical stop to "catch" the lip of the container and help to direct it into the interior portion 205 of the lid 100.

Where the container receiving well 202 is included, the exterior 102 of the annular wall 201 will include a stair-step configured as a skirt disposed at the base of the annular wall. As shown in FIGS. 1-3, the annular wall includes a first major face 101 and a second major face 103. The first major face 101 circumscribes the container engagement mechanism disposed on the interior of the annular wall 201. The second major face 103 circumscribes the container receiving well 202. As shown and described, in one embodiment the perimeter measured about the first major face 101 is greater than the perimeter measured about the second major face 103. A transitional surface 106 may optionally be disposed between the first major face 101 and the second major face 103 as well. For example, the transitional surface may be a straight surface or a curved surface, such as a curved surface having a 1.0 millimeter radius.

A central surface 104 spans an interior of the lid 100 and spans an interior region of the annular wall 201. In one embodiment, which is best viewed in FIG. 2, the central surface 104 is configured in a conical shape with substantially flat cone sides 206 tapering from a base portion 207 of the conical shape disposed adjacent to the annular wall 201 to a point 208 disposed at an inner portion 105 of the central surface 104 that is distally located from the annular wall 201. In one embodiment, the point 208 is disposed at a medial location along the central surface 104 such that the conical shape forms a symmetrical cone, or as close as can be obtained thereto given mechanical tooling and manufacturing tolerances. In one embodiment, the substantially flat cone sides 206 are configured to be between one and three millimeters thick. For example, a thickness of 2.1 millimeters plus or minus 0.2 millimeters has been shown to work well in experimental testing.

For reference, the lid 100 can be thought of as having a top side 209 and a "container engaging side" 210. The top side 209 is the side exposed to the environment when the lid 100 is coupled to a container, while the container engaging side 210 receives the container and faces the interior of the container when sealed by the lid 100. In the illustrative embodiment of FIGS. 1-3, the conical shape is configured to extend from the annular wall 201 towards the container engaging side 210. Said differently, as viewed in FIG. 2, the point 208 points downward, or toward the container engaging side 210, while the base 207 is located higher along the annular wall 201 above the point 208. In one embodiment, the substantially flat cone sides 206 sides of the conical shape extend from the annular wall 201 at an angle 211 between sixty-five and seventy-five degrees. This results in a conical shape that is between three and ten millimeters in height 212. In one embodiment, the height 212 is between nine and ten millimeters.

When the lid 100 is sealed to a container, and pressure is either removed from the exterior of the system, such as when the system is transported through a pneumatic vacuum tube, or is added to the interior of the system, such as by fermentation of liquids contained within the system, the conical shape works as a mechanical buttress to improve the seal between the lid 100 and container. When the point 208 of the lid 100 is pushed outward, the annular wall 201 is pushed inward against the container, thereby increasing the integrity of the seal therebetween. This integrity enhancement can be increased by the coupling disposed between the central portion 105 and the annular wall 201.

While the central portion 105 can be coupled directly to the annular wall 201 in one embodiment, in another embodiment a bridge 213 couples the central portion 105 to the annular wall 201. In the illustrative embodiment of FIG. 2, the bridge 213 is arched on the top. The interior of the bridge 213 comprises a step 214 and a container lip edge receiving recess 215. In the view shown in FIG. 2, the step 214 is configured as a convex downward curving surface having a radius of about 2.2 millimeters, while the container lip edge receiving recess 215 is a concave downward curving surface having a radius of about 2.2 millimeters. When a container engages the lid 100, the lip of the container is directed into the container lip edge receiving recess 215. When the conical shape of the central portion 105 is deflected outward, the step 214 works as a mechanical stop and presses against the outer portion of the lid of the container, thereby increasing the integrity of the seal.

The lid 100 can be coupled to a container in many ways, including by way of mechanical locks, snaps, and the like. In one embodiment, the lid 100 is configured to be screwed onto the container to form a hermetic seal. In such an embodiment, the lid 100 comprises an inclined plane 216 disposed along an interior portion of the annular wall 201 so as to define a thread. Experimental testing has shown that dual thread systems work well in medical applications. Accordingly, in one embodiment the inclined plane 216 is configured to have a substantially triangular cross-section so as to engage a complementary dual thread on the container.

As will be described below, in one embodiment of a container system employing the lid 100, the system is configured to provide an audible "click" when the lid 100 is properly seated on the container. This audible click can be accomplished with a mechanical feature disposed on the lid 100 and a complementary mechanical feature disposed on the container, as will be described below.

To provide the audible click, the lid 100 can optionally include an audible lock actuation protrusion 217 extending the inner surface 204 of the container receiving well 202. As will be shown below, the audible lock actuation protrusion 217 engages a cantilevered audible lock projection on the container to create a "click" when the lid 100 is sealed to the container.

In one embodiment, when the lid 100 is coupled to a container, the resulting system is configured to be transportable in a pneumatic vacuum transportation system. In such a configuration, the diameter of the lid 100 is configured to fit within the transport tubes of such as system. To help facilitate such transport, the lid 100 can include a plurality of mechanical walls 107,108,109 extending distally from the second major face 103 of the annular wall 201 along the first major face 101. In one embodiment, each of the plurality of mechanical walls 107,108,109 is substantially parallel with the others. The plurality of mechanical walls 107,108,109 can provide assistance in opening and closing a container as they form a frictional surface between a medical services provider's hand and the lid 100 as well.

Figure 4:
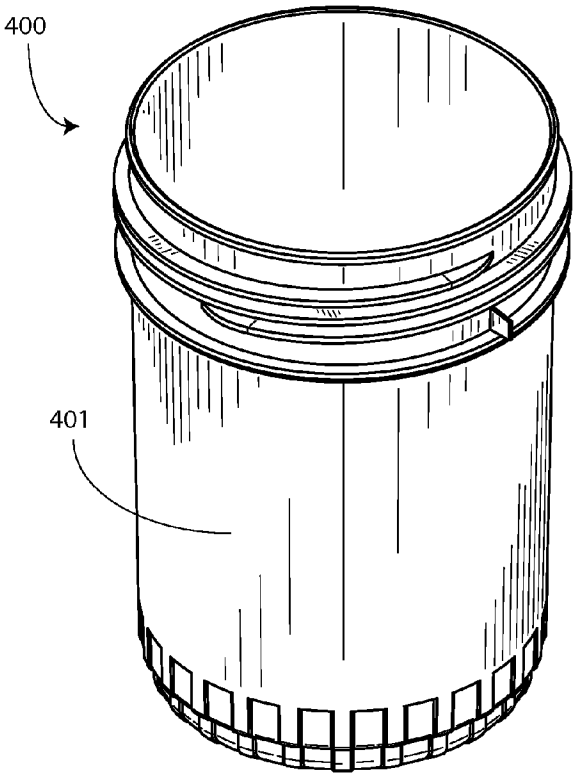
FIG. 4 illustrates a perspective view of one container configured in accordance with embodiments of the invention.
Figure 7:
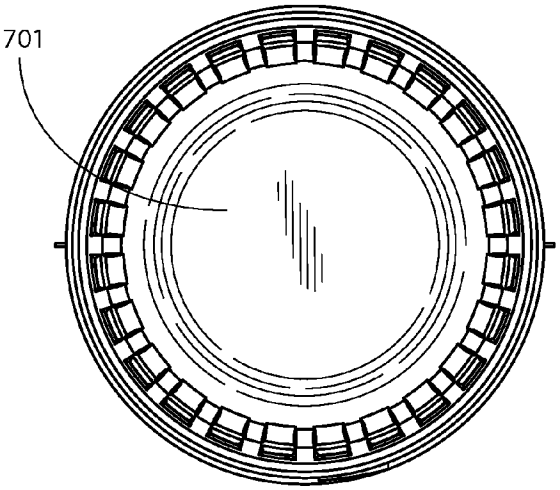
FIG. 7 illustrates a bottom plan view of one container configured in accordance with embodiments of the invention.

Turning now to FIGS. 4-7, illustrated therein is a container 400 suitable for coupling to a lid (100) to form a specimen container system in accordance with embodiments of the invention. FIG. 1 illustrates a perspective view, while FIG. 3 illustrates a side elevation view. FIG. 2 illustrates a sectional view cut along a diameter of the container 400. FIG. 4 illustrates a bottom plan view of the container 400. In one embodiment, the container 400 is configured to hold between three and four fluid ounces of liquid. Illustrating by way of example, the container 400 may have a diameter of between forty-four and forty-eight millimeters and a height of between seventy and seventy-five millimeters.

The container 400 includes a cylindrical sidewall 401 that extends from a base 701. In one embodiment, the cylindrical sidewall 401 is modestly tapered, such as by two degrees. For example, a diameter at a bottom 501 of the container 400 may be 46.56 millimeters while a diameter at the top 502 of the container 400 may be 47.6 millimeters. Such a taper can help the container 400 be extracted from a manufacturing tool.

In one embodiment, a lid engaging stop 503 extends outwardly from the cylindrical side wall 401. The lid engagement stop 503 works to ensure that the lid (100) properly seals with the container 400 by pressing against the bottom portion of the lid (100).

Figure 6:
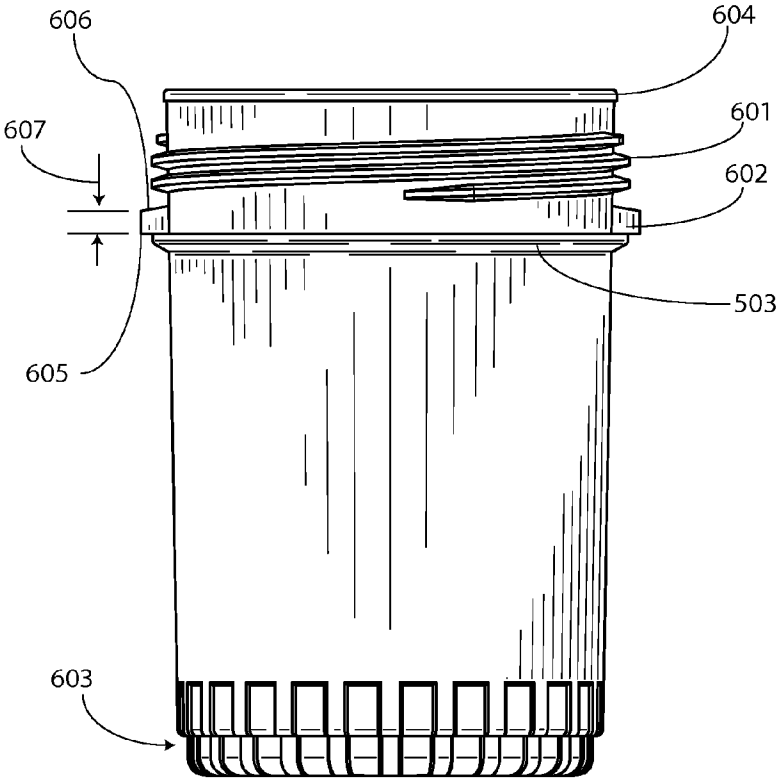
FIG. 6 illustrates a side elevation view of one container configured in accordance with embodiments of the invention.

As noted above, in one embodiment the lid (100) is configured to twist onto the container. Recall that the lid (100) included an inclined plane (216) that defined a thread. To engage such a thread, the container 400 can include a corresponding inclined plane 601 defining a thread disposed about an outer surface of the cylindrical side wall 401 as shown in FIG. 6. As also noted above, experimental testing has shown that a dual thread works well in medical applications. Thus, as shown in FIG. 6, the inclined plane 601 is configured as a dual inclined plane so as to function as a dual thread system. In the illustrative embodiment shown, the inclined plane 601 is disposed along the cylindrical side wall 401 opposite the lid engagement stop 503 relative to the base 701. The inclined plane 601, in one embodiment, extends about 2.8 millimeters from the cylindrical sidewall 401.

In one embodiment, the container lip 504 includes a lip protrusion 604 extending outwardly therefrom. The lip protrusion 604, where included, is configured to seat against the step (214) of the lid (100) when the lid (100) is seated on the container.

The base 701 may be configured with a stair step inward protrusion 603 to suit some applications. This stair step inward protrusion results in the bottom of the base 701 being narrower than the bottom of the cylindrical sidewall 401. Illustrating by way of example, the base of the cylindrical sidewall 401 may have a diameter of 46.56 millimeters, while the bottom of the base 701 has a diameter of 44.29 millimeters.

As noted above, in one embodiment the lid and container system is optionally configured to provide an audible click when the lid (100) is properly seated on the container 400. Recall from above that in one embodiment, the lid (100) included an audible lock actuation protrusion (217). In one embodiment of the container 400, an audible lock projection 602 extends outwardly from the cylindrical sidewall 401. In the illustrative embodiment of FIG. 6, the audible lock projection 602 is disposed between the lid engagement stop 503 and the inclined plane 601 and adjacent to the lid engagement stop 503.

In one embodiment, the audible lock projection 602 can be configured as a cantilever beam that is deflected when engaged by the audible lock actuation protrusion (217). Upon deflecting back, the audible lock projection 602 makes an audible click sound.

In one embodiment, the audible lock projection 602 includes a first edge 605 that extends substantially orthogonally from the cylindrical sidewall 401 and a second edge 606 that extends from the cylindrical sidewall 401 at an obtuse angle. In one embodiment, the audible lock projection 602 has an outer height 607 of between two and three millimeters, such as 2.5 millimeters. In one embodiment, the audible lock projection 602 has a thickness of about 0.40 millimeters.

Figure 8:
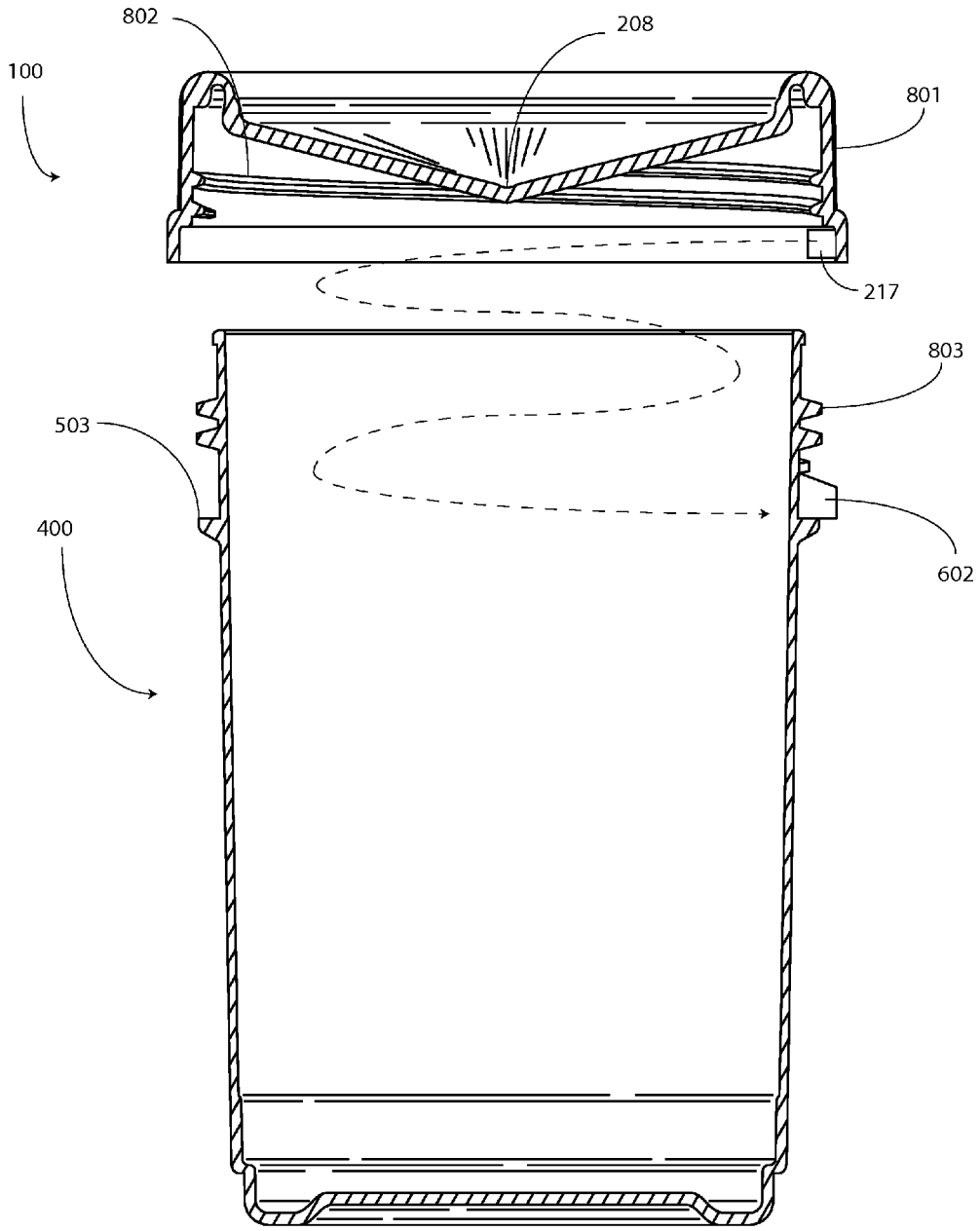
FIG. 8 illustrates an exploded view of a specimen container system configured in accordance with embodiments of the present invention.

Turning now to FIG. 8, illustrated therein is an exploded view of a specimen container system 800 configured in accordance with embodiments of the invention. The specimen container system 800 of FIG. 8 includes the lid 100 of FIG. 2 and the container 400 of FIG. 5. The exploded view of FIG. 8 is shown as a sectional view with the lid 100 and container 400 being sectioned along their respective diameters.

As described above, the lid 100 includes a central surface 104 spanning the interior of the lid 100. The central surface 104 is configured in a conical shape and tapers towards the container 400 from an outer wall 801 of the lid 100 to a point 208 centrally disposed along the central surface 104.

The lid 100 includes a container engagement mechanism 802, which is configured in this illustrative embodiment as a screw thread. Accordingly, the container 400 includes a lid engagement mechanism 803, which in this embodiment is configured as a dual screw thread that is complementary in mechanical configuration with the container engagement mechanism 802. A user seals the lid 100 and container 400 together by twisting the lid 100 so that the container engagement mechanism 802 engages the lid engagement mechanism 803.

The illustrative embodiment of FIG. 8 includes the audible locking mechanism described above. Specifically, the lid 100 includes the audible lock actuation protrusion 217 and the container 400 includes the audible lock projection 602. As the user twists the lid 100 onto the container 400, with the container engagement mechanism 802 engaging the lid engagement mechanism 803, the audible lock actuation protrusion 217 will engage the audible lock projection 602 as the lid 100 begins to seat against the lid engagement stop 503. This engagement causes the audible lock projection 602 to deflect and snap back, thereby delivering an audible click to the user. In one embodiment, the audible lock actuation protrusion 217 is disposed along the container 400 so as to deflect back just as the lid 100 seats against the lid engagement stop 503.

Figure 9:
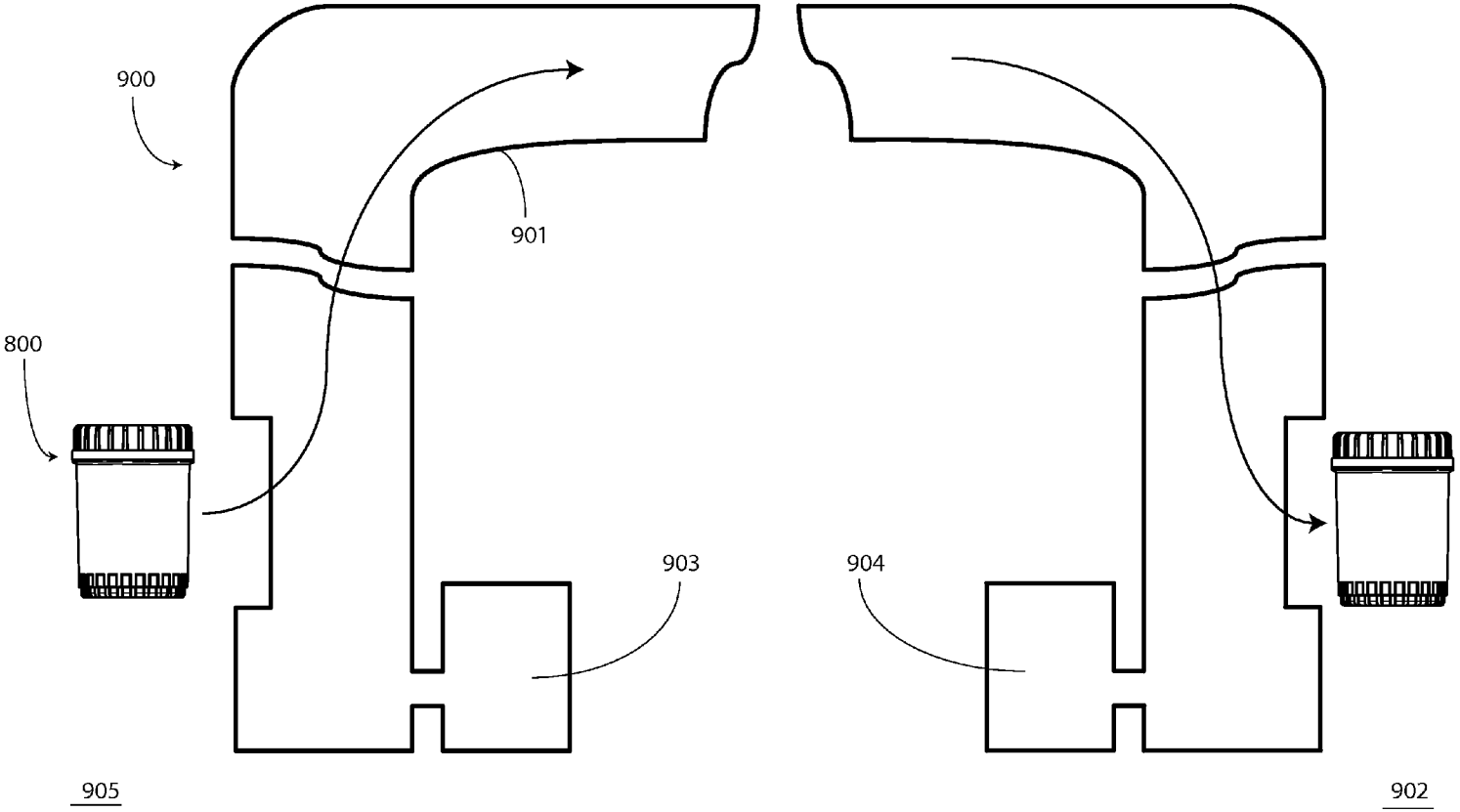
FIG. 9 illustrates one mode of transport suitable for container systems configured in accordance with embodiments of the present invention.

Once thusly engaged, the lid 100 and container 400 form a vessel that is suitable for transport in a pneumatic or vacuum transportation tube system. These systems are well known in the art, and are in use by banks, retail stores, and medical facilities alike. Turning now to FIG. 9, illustrated therein is such a system.

As shown in FIG. 9, a pneumatic tube transport system 900 is used for transporting objects. In one embodiment, the specimen container system 800 of FIG. 8 is configured such that the lid (100) and container (400) fit within the vacuum transportation tube 901. In so doing, the specimen container system 800 can be transported from one location 905 in the building to another 902.

Vacuum pumps 903,904 selectively evacuate air from, or force air into, the vacuum transportation tube 901. In use, a person places the specimen container system 800 into the vacuum transportation tube 901. The specimen container system 800 is then propelled through the vacuum transportation tube 901 when the vacuum pumps 903,904 create a zone of relatively higher pressure on one side of the specimen container system 800 than on the other. This may be accomplished by creating a zone of negative pressure (e.g. a vacuum) in front of the specimen container system 800 or by creating a zone of positive pressure behind the specimen container system 800. The conical shape of the central portion (104) of the lid (100) works as described above to ensure that the specimen container system 800 remains leak-proof even under vacuum pressure exerted by the vacuum pumps 903, 904.

In the foregoing specification, specific embodiments of the present invention have been described. However, one of ordinary skill in the art appreciates that various modifications and changes can be made without departing from the scope of the present invention as set forth in the claims below. Thus, while preferred embodiments of the invention have been illustrated and described, it is clear that the invention is not so limited. Numerous modifications, changes, variations, substitutions, and equivalents will occur to those skilled in the art without departing from the spirit and scope of the present invention as defined by the following claims. Accordingly, the specification and figures are to be regarded in an illustrative rather than a restrictive sense, and all such modifications are intended to be included within the scope of present invention. The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

What is claimed is:

1. A specimen container system, comprising:

a lid comprising a central surface spanning an interior of the lid, wherein the central surface is configured in a conical shape comprising substantially flat cone sides in cross-section tapering from an outer wall of the lid to a point;

and a container;

wherein:

the lid comprises a container engagement mechanism and the container comprises a lid engagement mechanism;

the lid comprises a container engaging side, wherein the conical shape extends from the outer wall towards the container engaging side; and when the conical shape is pushed outward from the container in response to pressure, the conical shape pushes the outer wall inward against an outer surface of the container to increase integrity of a seal therebetween.

2. The specimen container system of claim 1, wherein:

the lid comprises an audible lock actuation protrusion extending inwardly from the outer wall;

the container comprises an audible lock projection extending outwardly thereon;

wherein the audible lock projection is configured to audibly deflect when engaged by the audible lock actuation protrusion.

3. The specimen container system of claim 1, wherein the lid is configured to engage the container with a dual thread so as to form a vessel suitable for transport in a vacuum transportation tube.

4. The specimen container system of claim 1, wherein the point projects from the outer wall toward the container engaging side.

5. The specimen container system of claim 1, wherein the point is medially disposed along the central surface.

6. The specimen container system of claim 1, further comprising a bridge coupling the central surface to the outer wall.

7. The specimen container system of claim 6, wherein the bridge comprises a step and a container lip edge receiving recess disposed on the container engaging side between the outer wall and the central surface.

8. The specimen container system of claim 1, further comprising an inclined plane defining a thread disposed along an interior of the outer wall.

9. The specimen container system of claim 8, wherein the inclined plane is configured to engage a dual thread of the container.

10. The specimen container system of claim 1, further comprising a container receiving well disposed at a base of the outer wall.

11. The specimen container system of claim 1, further comprising an audible lock actuation protrusion extending from an interior of the outer wall.

12. The specimen container system of claim 1, wherein the lid has a diameter configured to fit within a vacuum transportation tube.

13. The specimen container system of claim 1, wherein the conical shape is between three millimeters and ten millimeters in height.

14. The specimen container system of claim 1, wherein the substantially flat cone sides of the conical shape extend from the outer wall at between sixty-five and seventy-five degrees.

15. The specimen container system of claim 1, the container comprising:

a cylindrical side wall extending from a base;

a lid engagement stop extending outwardly from the cylindrical side wall;

an inclined plane defining a thread disposed about a surface of the cylindrical side wall opposite the lid engagement stop relative to the base; and a cantilevered audible lock projection extending from the outer surface between the lid engagement stop and the inclined plane.

16. The specimen container system of claim 15, wherein the cantilevered audible lock projection comprises a first edge extending substantially orthogonally from the outer surface of the cylindrical side wall and a second edge extending at an obtuse angle from the outer surface of the cylindrical side wall.

17. The specimen container system of claim 16, wherein the cantilevered audible lock projection is disposed adjacent to the lid engagement stop.

* * * * *